US007967692B2

(12) United States Patent
Werner

(10) Patent No.: US 7,967,692 B2
(45) Date of Patent: Jun. 28, 2011

(54) WATER SLIDE AUDIO VISUAL ENTERTAINMENT SYSTEM

(76) Inventor: Michael F. Werner, Hawthon Woods, IL (US)

( * ) Notice: Subject to any disclaimer, the term of this patent is extended or adjusted under 35 U.S.C. 154(b) by 329 days.

(21) Appl. No.: 12/271,452

(22) Filed: Nov. 14, 2008

(65) Prior Publication Data

US 2009/0143155 A1 Jun. 4, 2009

Related U.S. Application Data

(63) Continuation-in-part of application No. 11/379,826, filed on Apr. 24, 2006, now abandoned.

(60) Provisional application No. 60/988,015, filed on Nov. 14, 2007.

(51) Int. Cl.
*A63G 21/18* (2006.01)
*A63G 31/00* (2006.01)

(52) U.S. Cl. ..... 472/117; 472/61; 472/128; 434/44

(58) Field of Classification Search ..... 472/58, 472/59, 61, 72, 74, 88, 90, 130, 116, 117, 472/134, 128; 434/38, 44, 247, 253
See application file for complete search history.

(56) References Cited

U.S. PATENT DOCUMENTS 5,219,315 A 6/1993 Fuller et al.
5,378,197 A 1/1995 Briggs
5,453,054 A 9/1995 Langford
5,482,510 A 1/1996 Ishii et al.
5,669,821 A 9/1997 Prather et al.
5,685,778 A 11/1997 Sheldon et al.
5,716,281 A 2/1998 Dote
6,007,338 A 12/1999 DiNunzio et al.
6,186,902 B1 2/2001 Briggs
6,224,491 B1 5/2001 Hiromi et al.
6,353,785 B1 * 3/2002 Shuman et al. ..... 701/48
6,364,490 B1 4/2002 Krause
6,375,578 B1 4/2002 Briggs
6,413,165 B1 7/2002 Crandall et al.
6,428,449 B1 8/2002 Apseloff
6,443,849 B1 9/2002 Byrd
6,488,590 B2 12/2002 Katayama
6,702,687 B1 3/2004 Henry
6,819,487 B2 11/2004 Palovuori et al.
6,834,966 B1 12/2004 Moquin
6,847,892 B2 1/2005 Zhou et al.

OTHER PUBLICATIONS

International Search Report and Written Opinion issued in related PCT Patent Application No. PCT/US2006/15224, 16 pages.
Select File History from related U.S. Appl. No. 11/379,826, filed Apr. 24, 2006, dated Aug. 1, 2006 through Dec. 22, 2008, 53 pages.
Office Action in related U.S. Appl. No. 11/379,826, dated Apr. 14, 2009, page.

* cited by examiner

*Primary Examiner* — Kien T Nguyen
(74) *Attorney, Agent, or Firm* — Lathrop & Gage LLP

(57) ABSTRACT

An interactive water slide includes a plurality of light and sound sources synchronized with a theme chosen by the rider, the lighting and sound changes as the rider travels down the slide. Images are projected onto a screens of water that block the path of the rider and as the rider travels down the slide the rider must go through these projected images.

23 Claims, 14 Drawing Sheets

WATER SLIDE AUDIO VISUAL ENTERTAINMENT SYSTEM

CROSS-REFERENCE TO RELATED APPLICATIONS

This application claims benefit of U.S. Provisional Application No. 60/988,015, filed Nov. 14, 2007 and is also a continuation-in-part of U.S. patent application Ser. No. 11/379,826 filed Apr. 24, 2006 now abandoned the disclosures of which are incorporated herein by reference.

BACKGROUND OF THE INVENTION

1. Field of the Invention

The present invention relates generally to the field of amusement park rides and, more specifically, to water slides.

2. Description of the Related Art

Enclosed and other sorts of waterslides have been around for quite some time. They are usually found in water parks owned and operated by municipalities, resorts, amusement parks and private individuals. The basic premise for a water slide is that the rider enters a flume at the top, sometimes on a raft or other flotation device, and proceeds down a variable decline until exiting into a water-filled pool. The enjoyment comes from the speed and thrill of the decline, as well as the turns encountered before exiting. Conventionally some sound, lighting, and other effects have been used to add to the amusement of the rider. The rider of these conventional slides, however, must take the particular ride as it comes to him or her and has no control over the experience. Thus, there is a need in the art for a waterslide which affords the rider the opportunity to participate in the experience.

SUMMARY OF THE INVENTION

The present invention solves these shortcomings in the prior art by providing a water slide system which in one embodiment comprises a user interface which presents a menu to the operator. The menu includes a number of ride theme options. The system is also adapted to enable the operator (e.g., rider) to make a selection of a ride theme options. Once this has occurred, a computing arrangement receives the selection and causes one or more special effects to be created on or about the waterslide (e.g. audio, video, water sprays, fog). These effects, in the preferred embodiment, are consistent with some kind of theme.

In another embodiment, the rider makes no selection and the computer selects a random theme for them once a sliding rider reaches and then trips the first sensor at the top of the slide. This provides a random selection process with multiple theme possibilities.

In another embodiment, the invention relates to a water-spray device adapted to generate a spray of water into the slide path in combination with a projection arrangement. The projection arrangement is adapted to project images into the spray of water for the purpose of creating a special effect which may be seen by said rider, and then the rider passes through the image.

In another embodiment, the invention relates to a computer controlled timing arrangement in which sensors detect a riders position on the slide and play audio/visual content at an appropriate time and location such that the rider is able to enjoy a choreographed, themed experience as he or she descends.

DETAILED DESCRIPTION OF THE PREFERRED EMBODIMENTS

Figure 1:
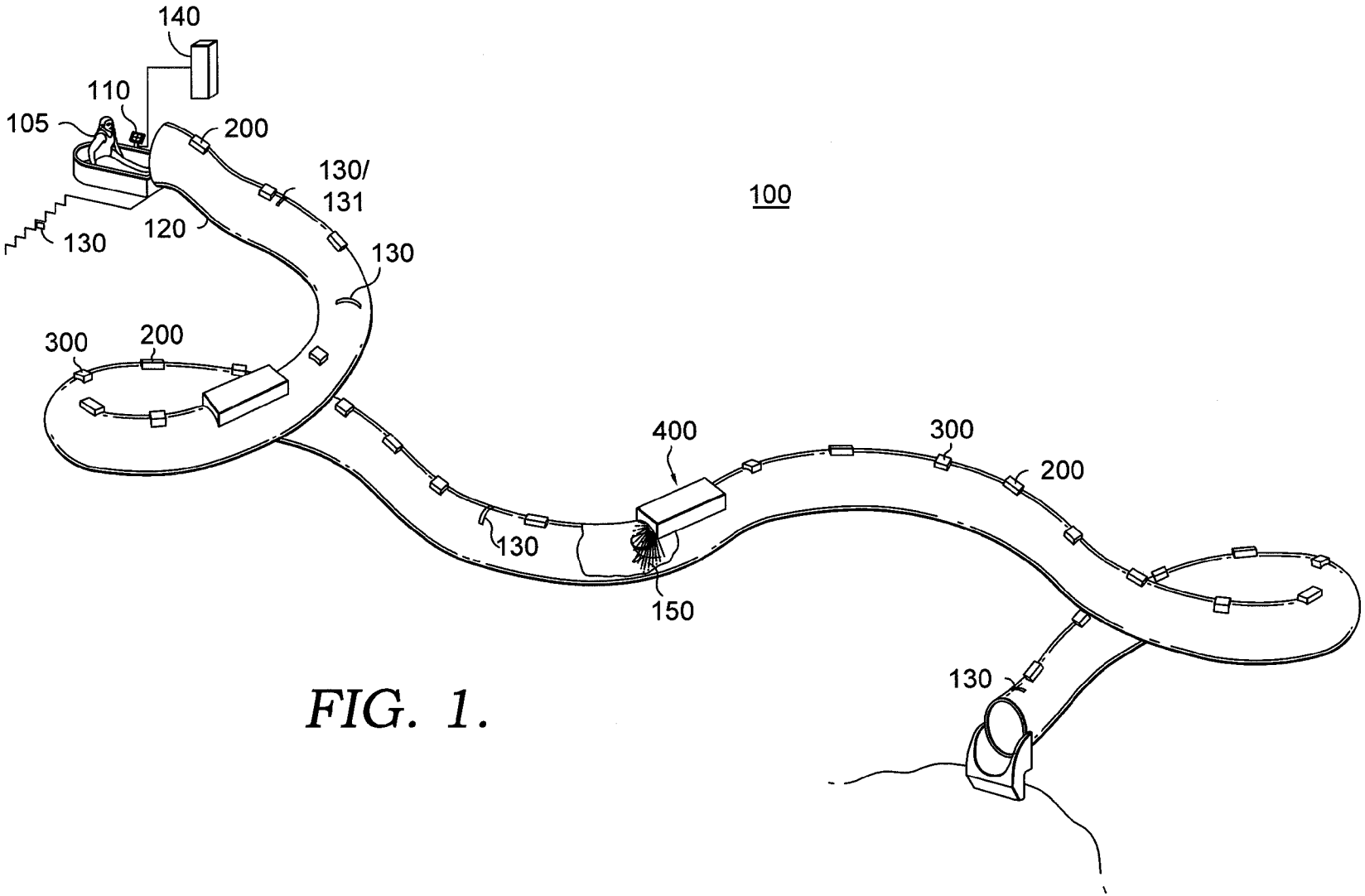
FIG. 1 is a schematic diagram of a water slide system in accordance with the present invention.

Referring to FIGS. 1-11, a water slide system 100 is disclosed. System 100 includes audio/visual effects equipment. Water slide system 100 has selectable themes, and includes an interactive water slide special effects control and playback system that will give the rider a choice of various themed experiences which will be accomplished through the use of electronically-controlled and synchronized sound effects, lighting and lighting patterns, water spraying from nozzles, and images projected from any number and variety of projection devices directly or remotely via fiber optic fed optical devices.

Water slide system 100 includes water slide 120, a plurality of lighting assemblies 200, a plurality of speaker assemblies 300, and at least one projection system 400. Water slide 120, in one embodiment, is at least partially enclosed. In one embodiment, the entire slide is enclosed. In another embodiment, the water slide is open at the beginning and end of the slide, the remainder of the slide enclosed. In further alternative embodiments, all or portions of the slide are open, and others or the entire slide are closed. The broad aspects of the disclosed invention will work with any arrangement.

Water slide system 100 further includes a plurality of motion sensors spaced along the water slide. Water slide system 100 also includes hardware and software and combinations thereof for operating lighting assemblies 200, speaker assemblies 300, projection assemblies 400 and various other components of system 100 discussed in more detail below.

Referring to FIG. 1, at the top (beginning) of the waterslide the user/rider 105 is presented with a control panel 110. Control panel 110 provides a user interface for allowing the rider 105 to select a ride theme from a plurality of ride themes available. Control panel 110 may include a push button, touch sensitive, or computer touch screen interface. The rider 105 may choose from several different labeled themes such as, for example, an ocean theme, a jungle theme, an arctic theme and a space theme. Once the rider makes the choice the rider begins their voyage down the water slide. Upon entering the water slide, the rider notices that the color of the interior of the water slide has changed to represent the theme and the sounds inside the water slide also represent the chosen theme.

In one embodiment, the rider can experience different sound effects and see different lighting than the effects for the chosen theme due to the theme selected by the preceding rider. The lighting and sound change continuously in keeping with the chosen theme as the rider 105 continues along the water slide. The light emanates from the plurality of lighting assemblies 200 (see FIGS. 3*a-c*) and the sounds emanate from the plurality of speaker assemblies 300 (see FIGS. 4*a-c*).

In one embodiment, motion sensors 130 located along the water slide 120 detect the rider as the rider passes the sensor. The motion sensor may then send a signal to a controller 140 which is connected to the motion sensor 130. The signal may be a signal to change the lighting or to begin playing a different audio file to correspond with the theme and the location of the rider along the water slide. In one embodiment, the progression of the theme from one phase to the next is triggered by the rider passing a particular motion sensor. The progression of the theme as the rider travels along the water slide is coordinated with the detection of the rider passing the plurality of motion sensors. In this way, the ride can accommodate for the speed at which a rider traverses the ride and a choreographed, themed, ride experience can be enjoyed by the rider.

In another embodiment, more than one raft and rider can occupy the slide at the same time and the theme that each has selected will be choreographed for that rider.

Water slide system 100 further includes at least one water spray unit 150. Water spray units 150 may be located at various places along the water slide 120. In one embodiment, water spray unit 150 sprays water across the rider's path forming a screen of water the rider must pass through. In one embodiment, images are projected onto the water screen. The image is projected from projector system 400. The projected image may be in keeping with the chosen theme. For example, where the theme is an ocean theme, the projected images may be that of a shark. Those with skill in the art will readily recognize that a myriad of images may be projected such as for example, tigers, polar bears, aliens, monsters etc, in order to provide the rider with a thrilling ride. The number of water projection screens for projecting images may vary depending on the theme and the length of the water slide or the creative design.

Figure 2:
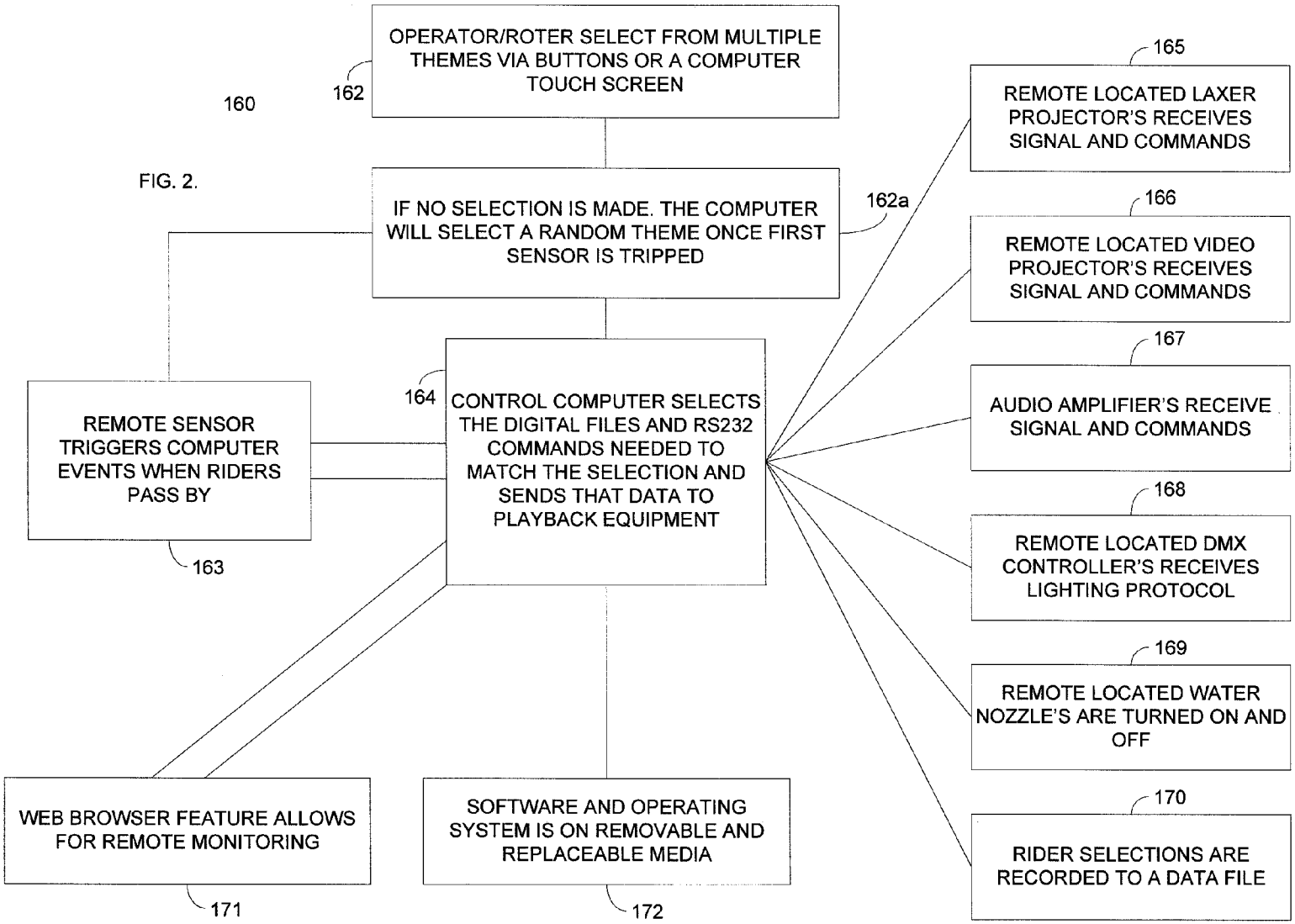
FIG. 2 is a schematic flow diagram showing the processes of one embodiment of the system 100 illustrated in FIG. 1.

Referring to FIG. 2, FIG. 2 is a schematic diagram of one embodiment of the operating system and method 160 for operating water slide system 100. Computer arrangement/controller 140 includes software and hardware to control the various components of water slide 100. In the preferred embodiment, controller 140 is a server. It could instead be another kind of computing device, e.g., a personal computer, programmable logic controller (PLC), other computing device, or a plurality of like or dissimilar computing devices on a network and still fall within the scope of the invention. Further, the FIG. 1 representation of computing device 140 shows it as proximate the top of the slide for the sake of illustration. It should be noted, however, that in some embodiments this device would be located at a considerable distance from the top of the slide. It could alternatively be at another location in the theme park, or even off site and still would be within the scope of the broad contemplations of this invention.

At the beginning of the ride when the operator/rider selects the theme in a step 162. If in a next step 162*a*, no selection is made, the controller 140 will select a random theme once the first sensor at the top of the slide 131 is tripped. Regardless, the process will continue to a step 164 in which software on controller 140 identifies the requested selection, if one was made, and locates the associated files that will playback that theme. The associated files may be stored on controller 140. The files are of different standard protocols, such as .AVI file for the video, a DMX protocol for the lighting, RS232 commands to turn on and adjust specific pieces of equipment, .WAV file to playback audio, PCM files to playback digital audio files, USB commands etc. One skilled in the art will be familiar with these different file types as well as others which could be used to accomplish the objectives of the present invention.

The synchronized playback begins as the rider passes by the first motion sensor. The playback files are produced to present all the effects in sync with where the riders are along their ride path. This is accomplished with the help of the sensor devices 130. For example, just before the rider turns a corner they pass through a sensor that signals the software to begin to play a .WAV file, for example a file that says "Who Goes There." These sensors are placed throughout the ride to keep the software and playback in sync with the riders speed (Block 163). One skilled in the art will know how to prepare process which will be executed responsive to the tripping of the sensors to ensure the proper timing.

In the preferred embodiment, controller 140 sends command signals to laser projectors (in a step 165), video projectors (in a step 166), audio amplifiers/speakers (in a step 167), lighting systems (in a step 168) and water control systems (in a step 169) to cause their activation and deactivation.

Rider selections may be recorded to a data file in a step 170. In one embodiment, if the rider tries to repeat the same theme the software will select a variation of that theme for playback. In this way the rider can only make the theme selection and the software makes the selection for the exact files to be played back. This provides a different ride experience within the constraints of the number of options presented to the user/rider every time the water slide is used. In one embodiment, the rider is given a user code that is input into the control unit via the user interface 110. The themes and variations of the theme that the rider chooses may then be linked and stored to that user code. The user codes and associated stored files may be stored for any length of time, for example a day week or season. In this way, the user code may be reused/recycled as needed. Data from a previous code user may then be deleted as the user code is recycled. In one embodiment, the data is recorded by the software located at controller 140 and provided in a spreadsheet format for review. Alternatively the data could be accessed remotely over the internet. The data may include such things as, for example, which theme was selected by the user, the date and time the selection was made, the time it took for the rider to pass through each sensor as well as the total time the rider took to complete the ride. Data may be gathered for the purposes of managing high rider volume times, theme popularity, return on investment, and the total number of riders to date.

In one embodiment, the software will also have an over ride feature that will allow the lifeguard that is monitoring the rider safety to press an emergency button that stops all the audio and video playback as well as turns all the lighting to white. The software also is monitoring all the equipment via the many different interconnections. A ride technician may monitor the ride. In this one embodiment the ride monitor monitors the status of the playback system as well as all the connected hardware remotely in a step 171. Further, and also a part of step 171, the ride technician is able to administer software and media upgrades remotely over the remote interface. As a practical matter, in one embodiment, the ride system is monitored via the Internet. In another embodiment, the ride system is monitored via an intranet arrangement. These kinds of remote arrangements are very beneficial in some circumstances. For example, ride staff (typically non technically-minded persons) are completely eliminated from the ride control system monitoring process. Therefore, they are more able to devote themselves to park safety and other concerns and are not distracted.

In one embodiment, a sleep function is designed into the hardware and software of the playback system. In one example, after 10 minutes of no selections from the control panel the system sends out commands to all the hardware to turn off. This feature will save electrical energy as well as extend the life of the hardware. In another or the same embodiment, the system may be turned on or reawakened when a new rider begins to climb the stairs of the tower leading to the beginning of the water slide. In this embodiment a motion or pressure sensor strategically placed on the stairs or elsewhere would send a signal to the control system and commands are issued to turn on all the hardware when a rider is approaching.

Figure 3A:
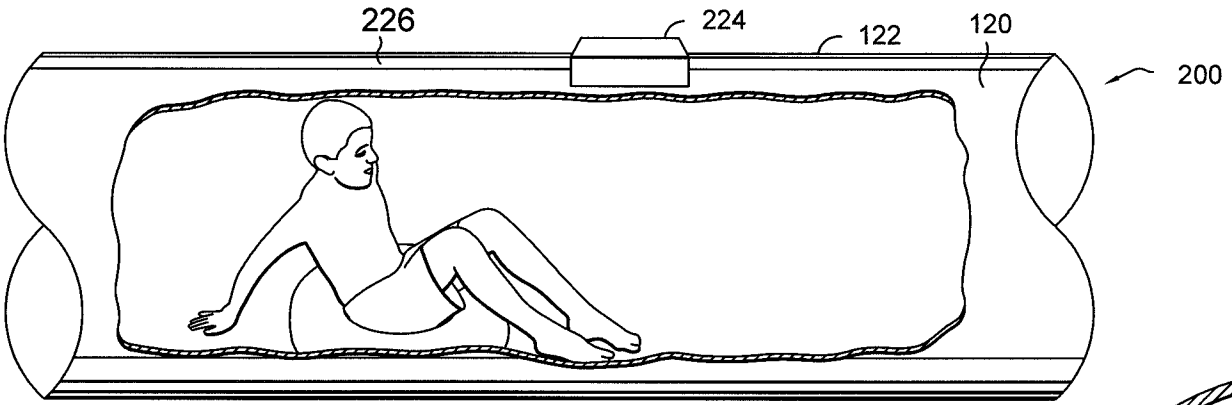
FIGS. 3*a-c* show one embodiment of a lighting assembly for system 100 illustrated in FIG. 1.
Figure 3B:
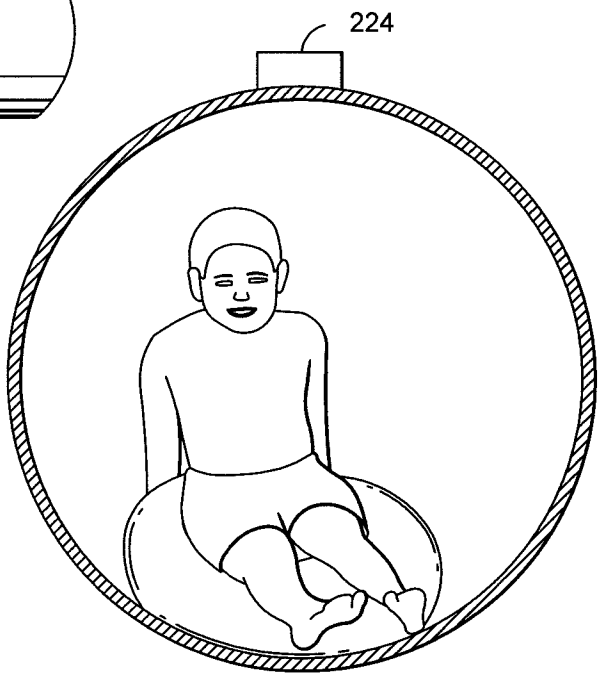
Figure 3C:
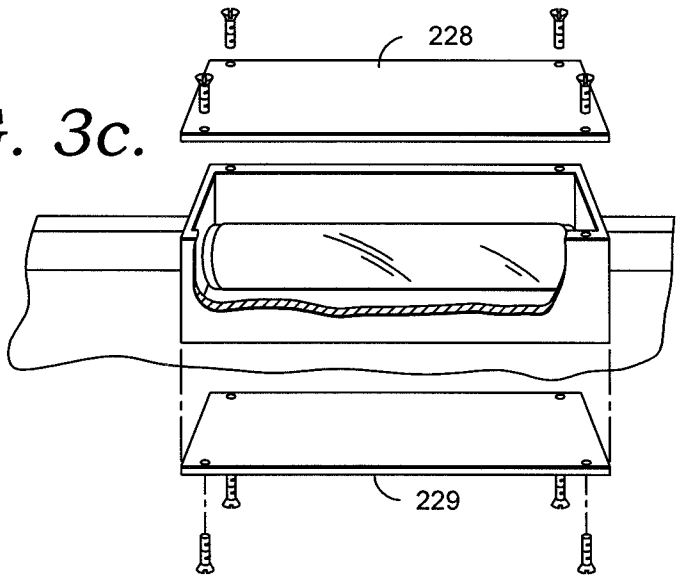

Referring to FIGS. 3*a-c*, an embodiment of a lighting assembly for water ride system 100 is disclosed. Water ride system 100 includes a plurality of spaced apart lighting assemblies 200. Lighting assemblies 200 are spaced along the length of the water slide 120 and are shown in the disclosed embodiment to be at the top of the slide. Lighting assembly 200 located at the top of the water slide tube 122. Lighting assembly 200 includes at least one light source 224 and light enclosure 226. In one embodiment, light enclosure 226 is weatherproof to protect light source 224 and associated components from damage due to such things as rain. Light source 224 may be a fluorescent light source, LED light source, strobe or any other light source. In one embodiment, light source 224 is a neon light as is known in the art. The lighting, in the disclosed embodiment, is positioned on the upper most center of the perimeter of the tube. It should be mentioned, however, that the lights could be positioned off center as well and still fall within the scope of the claimed invention. The lights are enclosed in a weather proof housing that can be opened from either the inside or outside of the slide for servicing. Servicing may be accomplished through the removal of an exterior lid 228 covering the enclosure 226, or from inside the slide by removing an interior lid 229. Because the interior lid is removable, technicians are able to access it from inside the slide as well.

The light emitted from light source 224 may point in any direction suitable for the chosen theme. The light may be emitted to bathe the entire water chute with light or may be emitted in directed beams of light. In one embodiment, the lights are pointing downward to allow for the maximum foot candles desired.

Figure 4A:
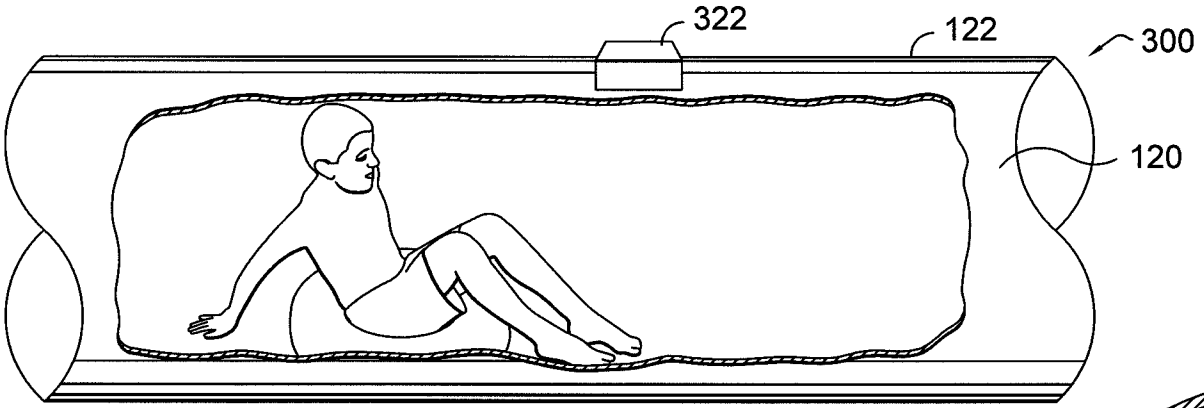
FIGS. 4*a-c* show one embodiment of a speaker assembly for system 100 illustrated in FIG. 1.
Figure 4B:
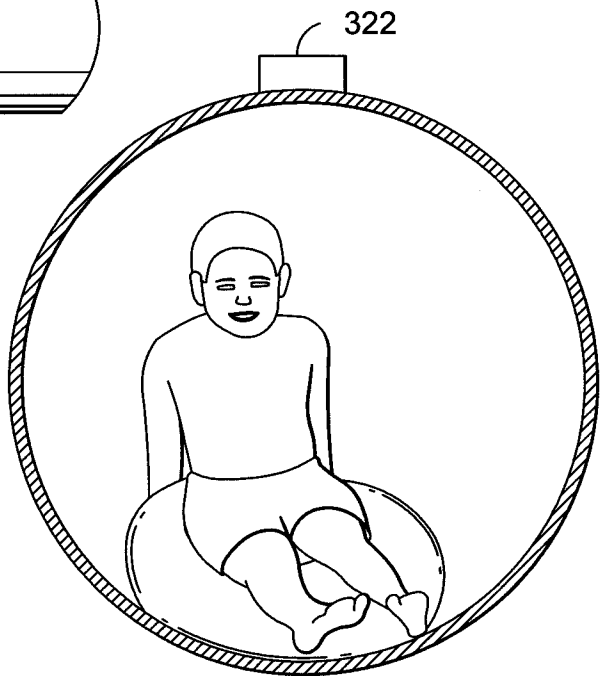
Figure 4C:
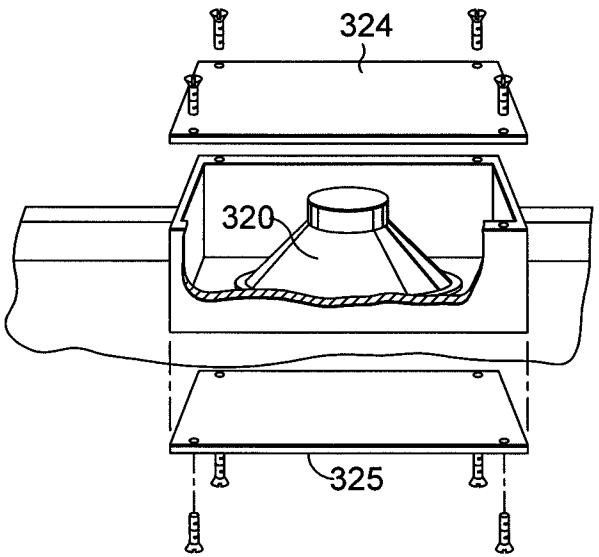

Referring to FIGS. 4*a-c*, a speaker assembly 300 for water ride system 100 is shown. Water ride system 100 includes a plurality of spaced apart speaker assemblies 300. Speaker assemblies 300 are spaced along the length of the water slide 120. Speaker assemblies 300 and lighting assemblies 200 may be positioned in an alternating manner along the length of the water slide 120. In another embodiment, lighting fixtures 224 and speakers 320 are located in the same enclosure. Speaker assembly 300 includes speaker 320 and speaker enclosure 322. The speakers 320 need to be of a waterproof nature and are positioned in the upper most center of the perimeter 122 of the water slide tube 120. But alternatively, the speakers could be positioned anywhere off center as well and still fall within the scope of the present invention. Regardless, the speakers should be positioned in a manner making it hearable by a rider. In the preferred embodiment the speakers are disclosed as facing downward so the sound exits towards the riders and the bottom of the tube. The speakers 320 are enclosed in a weather proof housing 322 that can be opened for servicing. Servicing may be accomplished through the removal of a lid 324 covering the enclosure 322 from outside the slide. Alternatively technicians will be able to service the speakers by removing an interior lid 325.

FIGS. 5 to 8 illustrate one embodiment of a projection system 400 for use in water ride system 100. Water ride system 100 includes at least one projection assembly. In one embodiment, water ride system 100 includes a projection assembly for each water spray unit 150.

Figure 5:
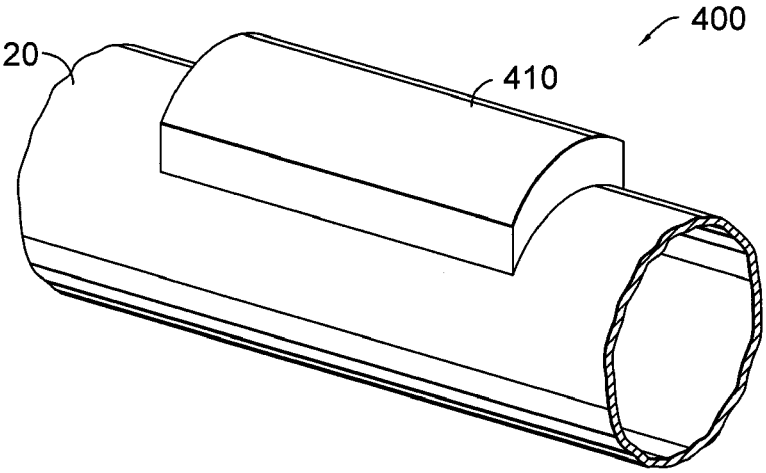
FIGS. 5 to 8 are schematic diagrams of one embodiment of an image projection system for system 100 illustrated in FIG. 1.
Figure 6:
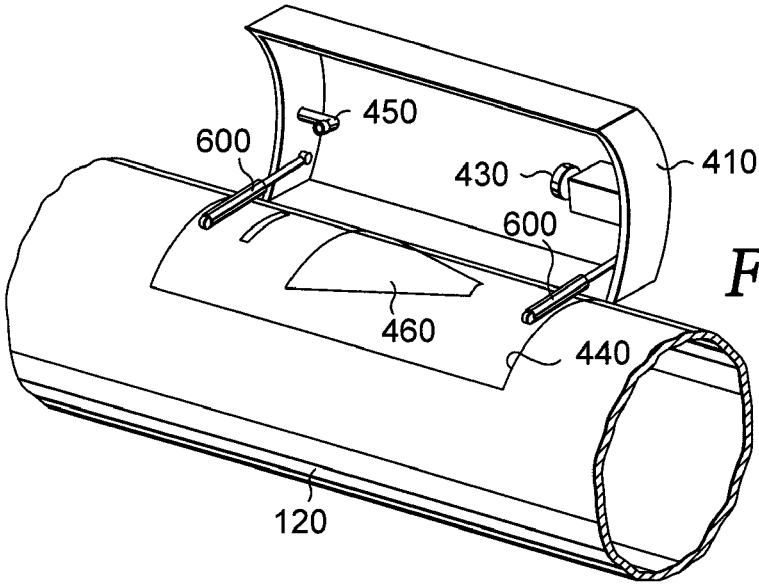
Figure 7:
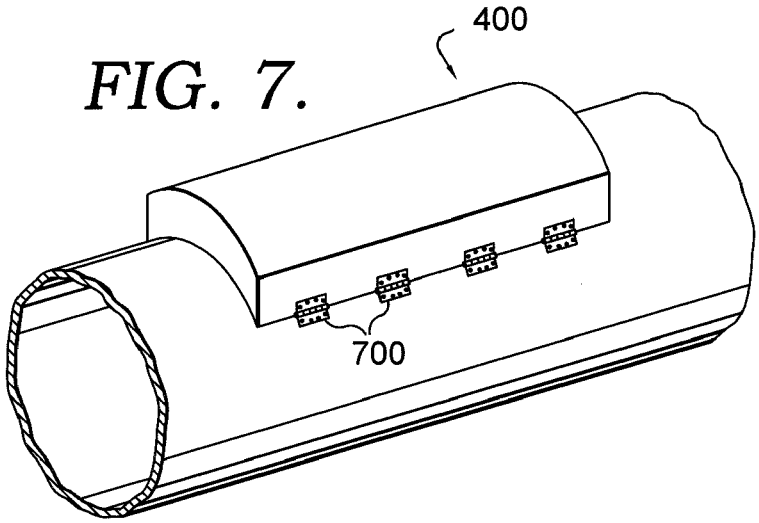

FIG. 5 illustrates an enclosure 410 for a projection assembly in closed position. Projection enclosure 410 may be a weatherproof enclosure for protecting projection assembly 420 located and mounted within enclosure 410. Alternatively, the projector could be mounted outside the enclosure and mounted to the slide itself. In the disclosed embodiment, projection enclosure 410 is curved to correspond with the curvature of the water slide tube. In cross section, projection enclosure 410 is located on the upper most center of the perimeter of the water slide tube 120. The projection enclosure 410 encloses the projector 430 for projecting images onto water spray 150. The projector 430 and associated components are housed in a weather proof enclosure 410 that can be opened from inside the tube for service. In one embodiment, gas shocks 600 may be operably attached to projection enclosure 410 to aid in the opening of the enclosure (see FIG. 6). In one embodiment, projection enclosure 410 is attached to water slide tube using a plurality of hinges 700 (see FIG. 7) about which the lid is openable. The hinge arrangement makes the projection assembly easily accessible if maintenance or repair of the projector is necessary. In one embodiment, the projectors are located behind, i.e. further down hill from, the water nozzle/s, at a distance ratio of 2:1 (2 feet of distance for every 1 foot of projected image size). The projected image passes through an opening in the perimeter of the water slide tube 120. The water slide tube includes an opening 460 located at the top perimeter of the tube (see FIG. 6). In this embodiment the nozzle opening 460 is located where it will be covered when the lid 410 is in closed position.

Since the cover of opening 460 is transparent, the image is clearly projected without substantial interference. The opening 460 that the projected images pass through must be covered with a clear flexible barrier 440. This barrier must also prevent the rider from entering or encountering the projection enclosure.

In the preferred embodiment nozzle 450 is the type having single or multiple flat fan shaped spray patterns. Nozzle 450 is received into a reciprocating aperture 451 so that it can spray into the enclosed slide. This makes it ideal for use as a projection screen.

Figure 9:
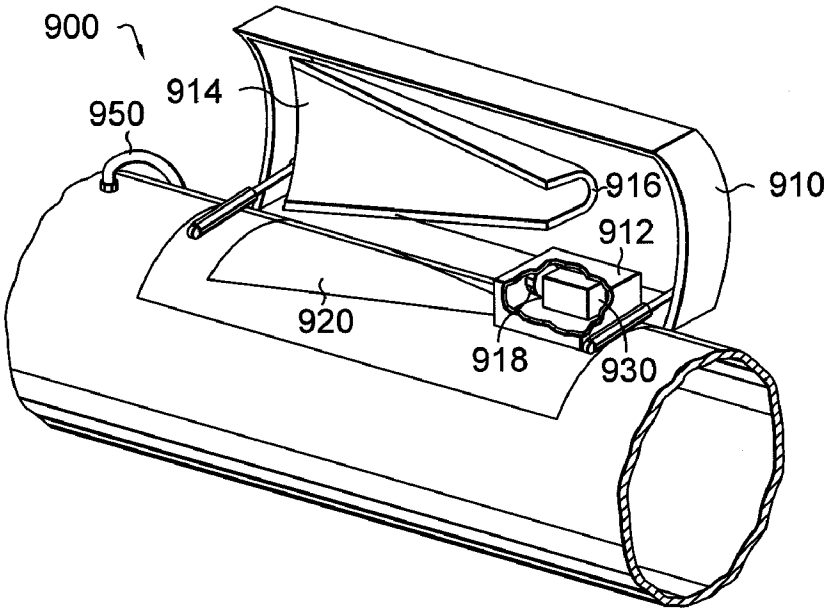
FIGS. 9-10 show an alternative embodiment for the image projection system.
Figure 10:
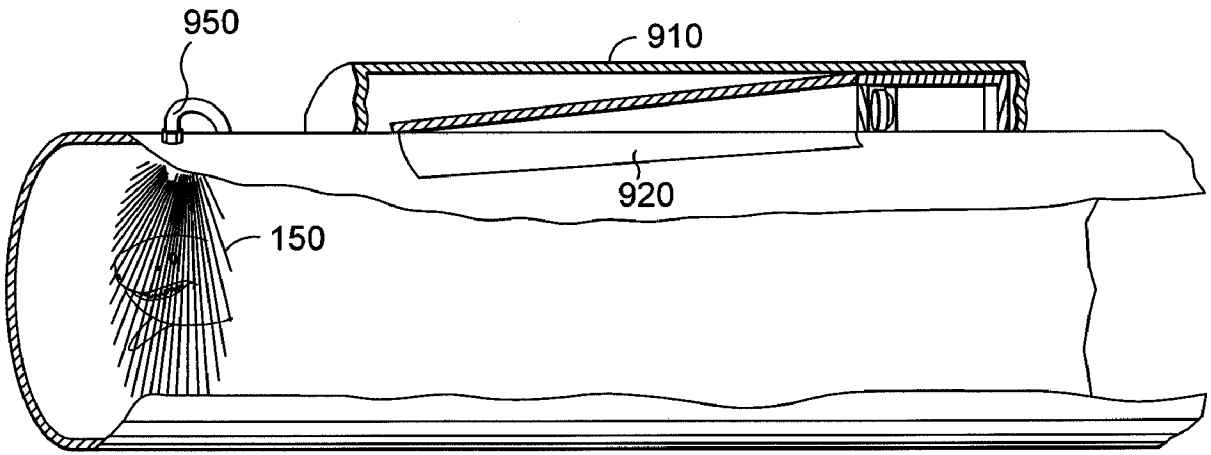

FIGS. 9 and 10 illustrate an alternative embodiment for a projection system 900 for use in water ride system 100. In this embodiment, a projector 930 is mounted inside the enclosure 910 in a waterproof projector housing 912. Box 912 is mounted directly onto the slide itself. The projector housing 912 encloses projector 930 such that it is able to project images onto substantially flat water spray 950. The weather proof housing 912 has a hole 916 cut out of one side to enable the lens portion 918 to protrude slightly. Because only the lens is exposed, the other water-vulnerable components of the projector are protected by the housing 912.

With this embodiment, there is no need for a transparent cover like cover 440. This is because this embodiment includes a splash guard 914 which is secured directly underneath the lid 910 and raises to an open truncated end 916. End 916 opens up to the lens 918 of projector 930 so that projected images are allowed to pass through an open area 920 defined into the top perimeter of the water slide tube. The details of how opening 920 allows the passage of the projected image are shown in FIG. 10.

The splashguard barrier 914, in addition to enabling the use of the protector, also prevents the rider from entering or encountering the projection enclosure. Because there is no need for a transparent protective cover like cover 440 in this embodiment, the projected image can be projected directly onto the water effect through a small optical window (opening 920). Thus, there is not interference by a cover. This enables better optical quality.

Another difference with the embodiment disclosed in FIGS. 9 and 10 regards the positioning of the nozzle. In this embodiment, nozzle 950 is located in advance of the housing/lid 910 (see FIGS. 9 and 10). Again, it is preferred but not necessary that nozzle 950 is the type having single or multiple flat fan shaped spray patterns. Nozzle 950 is received into a reciprocating aperture in the top of the enclosed slide. The nozzle position outside of lid 910 makes the nozzle substantially tamper proof by a slider, because lid 910 is normally in closed position during operation and will not appear to be liftable to the average slider. It is, however, accessible to repair persons who are able to stand up from inside the enclosed slide, stand up through opening 920, and access the nozzle.

Access to projector 930 and associated equipment for repairs can also be gained from inside the slide through opening 920. This may be necessary to clean the lens, reposition the projector or correct projection angle errors or other reasons.

Because the lights, speakers, projection devices nozzles, and other features are accessible from inside the enclosed slide, repair is made much easier. With conventional water slide arrangements, the access of any fixed equipment is difficult and dangerous where the equipment is located at high elevations. Thus, the accessibility offered here are a substantial improvement.

In all the embodiments, the projection arrangement gives the slider the thrill of passing through the water spray screen as moving images are being displayed.

All current and future protocols are supported by the software used. The associated files are produced in advance and are copied on to a removable computer media which gets plugged into the playback hardware. This allows for easy future theme changes without technical personnel present. In one embodiment, the electronic media is transferred directly to the computer via an internet or intranet connection.

Figure 11:
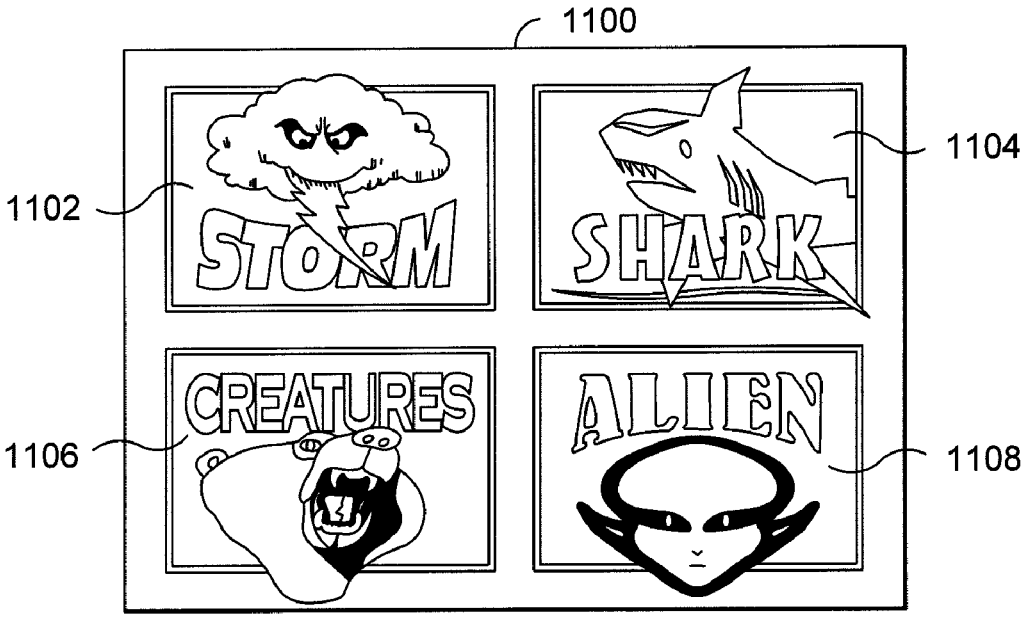
FIG. 11 shows a touch screen displaying an effect selection menu which is presented to a user at the top of the slide.

FIG. 11 shows a touch pad arrangement which might comprise control panel 110 in an embodiment. Referring to the figure, it may be seen that the device displays a screen 1000 which has a plurality of menu options, 1002, 1004, 1006, and 1008. In the preferred embodiment, panel 110 would be located at the top of the slide as shown in FIG. 1, where it would be encountered by a rider. Upon approaching the device, the rider would select one of the menu options 1002, 1004, 1006, or 1008, depending on the ride theme desired. Assuming the rider depresses menu option 1004 (which depicts a shark), that rider would encounter amusements during the ride consistent with a shark theme. This might, e.g., involve the playing of dramatic music which corresponds to the shark images projected. It also might involve still or moving images being presented to the sliding rider once he or she reaches projection assembly 400. In one embodiment, the moving or still images are displayed continuously from the time the rider makes their selection.

Figure 8:
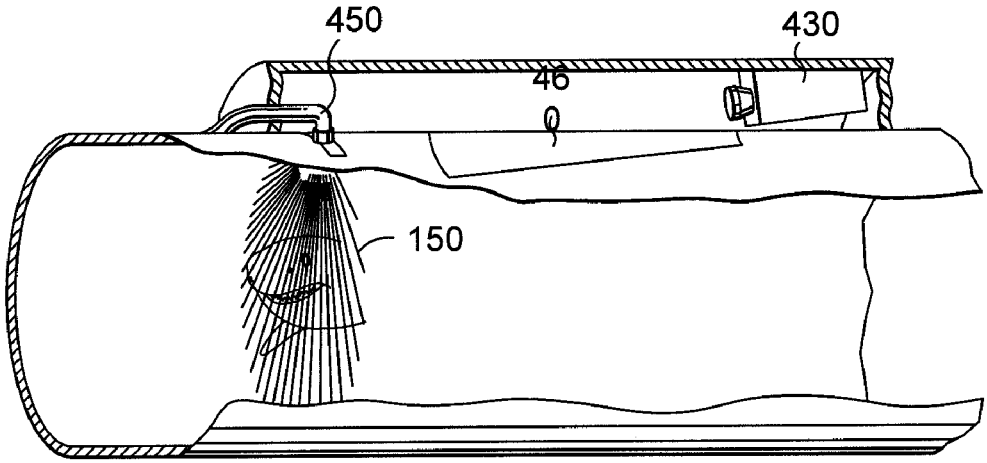

The touch pad interface 110 works together with the computer arrangement 140 to accomplish these objectives. Once a selection is made on touch screen 900, a signal relating to the selection made is transmitted to computing device 140. Upon receipt, a process running on computing device 140 will recognize the signal and begin the process of cueing up the proper lighting, audio files, spray sequencing, and video is prepared for the ride. Sensors 130 will indicate to the computing device 140 the position of the ride on the slide so that the lighting, sound, and other effects are automatically manipulated to occur at the time the rider reaches the proper position. The sensor information will also enable the computing device 140 to begin play of the video file (e.g., an MPEG) and begin spray from nozzle 450 when the rider is approaching the projection assembly 400. As can be seen in FIG. 8, a shark video is displayed which makes it appear to the rider that he or she is encountering a shark. Similarly, audio files could be played on speakers 300 all the way down the slide during the ride.

Thus, the rider is treated to a choreographed sequence of special effects during the course of the ride which all relate back to a common theme. And the next time down the slide, the rider is able to select a different theme. For example, upon completion of the shark ride, the rider could select the storm ride option 1002 (see FIG. 11) and be exposed to the sounds of high wind and thunder from speakers 300, lightning imitating flashing lights from light assemblies 200, and enter into a rotating tornado projected in assembly 400. It should be noted that different selection means could be used instead. For example, RFID bracelets could be attached to the riders. These bracelets could them be tracked by a reader along with a supporting computing system such that the reader/computer system tracks the RFID and produces particular themes which are customized depending on the rider's particular RFID information.

Figure 12A:
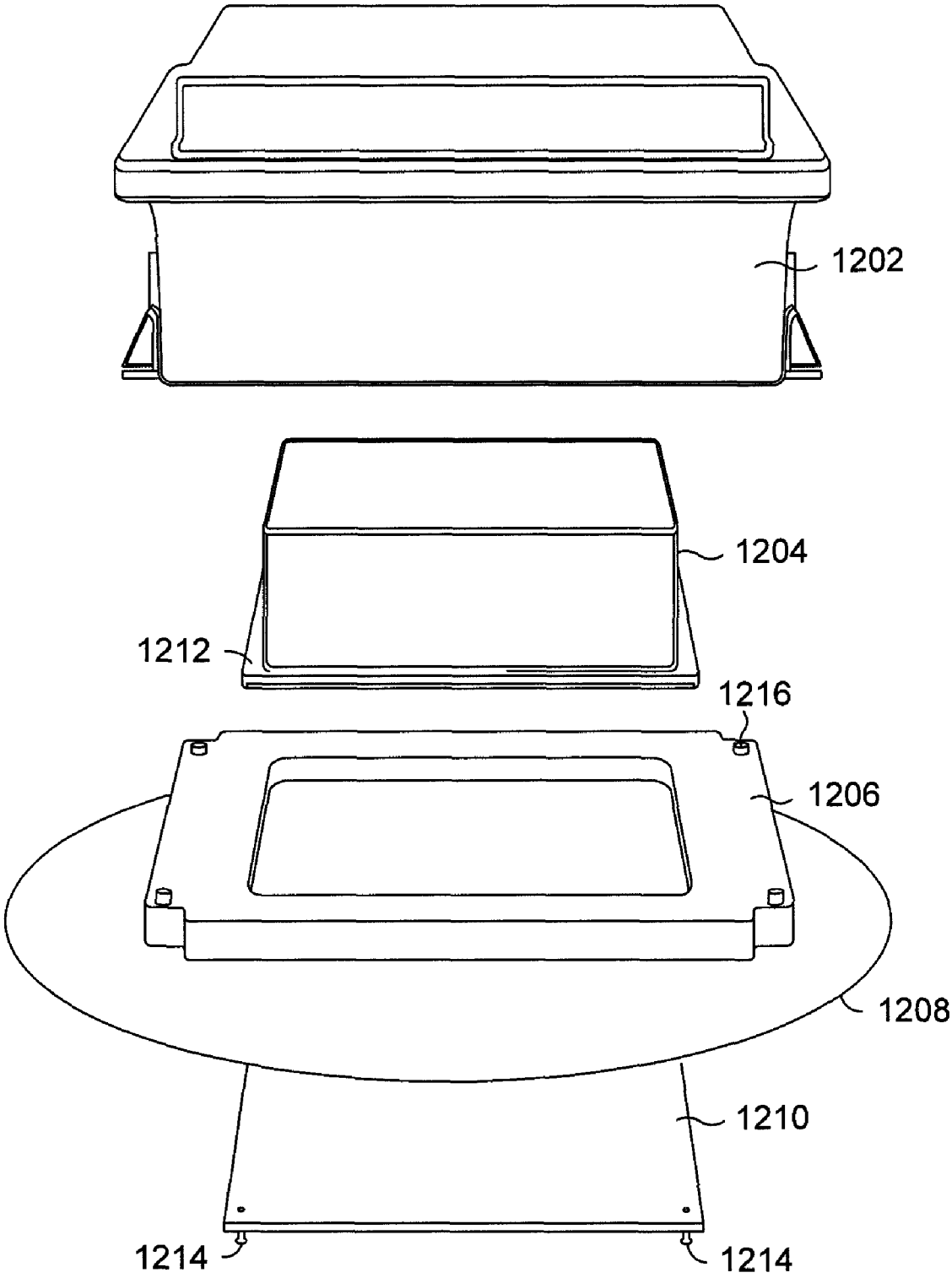
FIGS. 12-14 show a housing useable with the speaker or lighting assemblies shown, or with other electrical devices used in the waterslide.
Figure 12B:
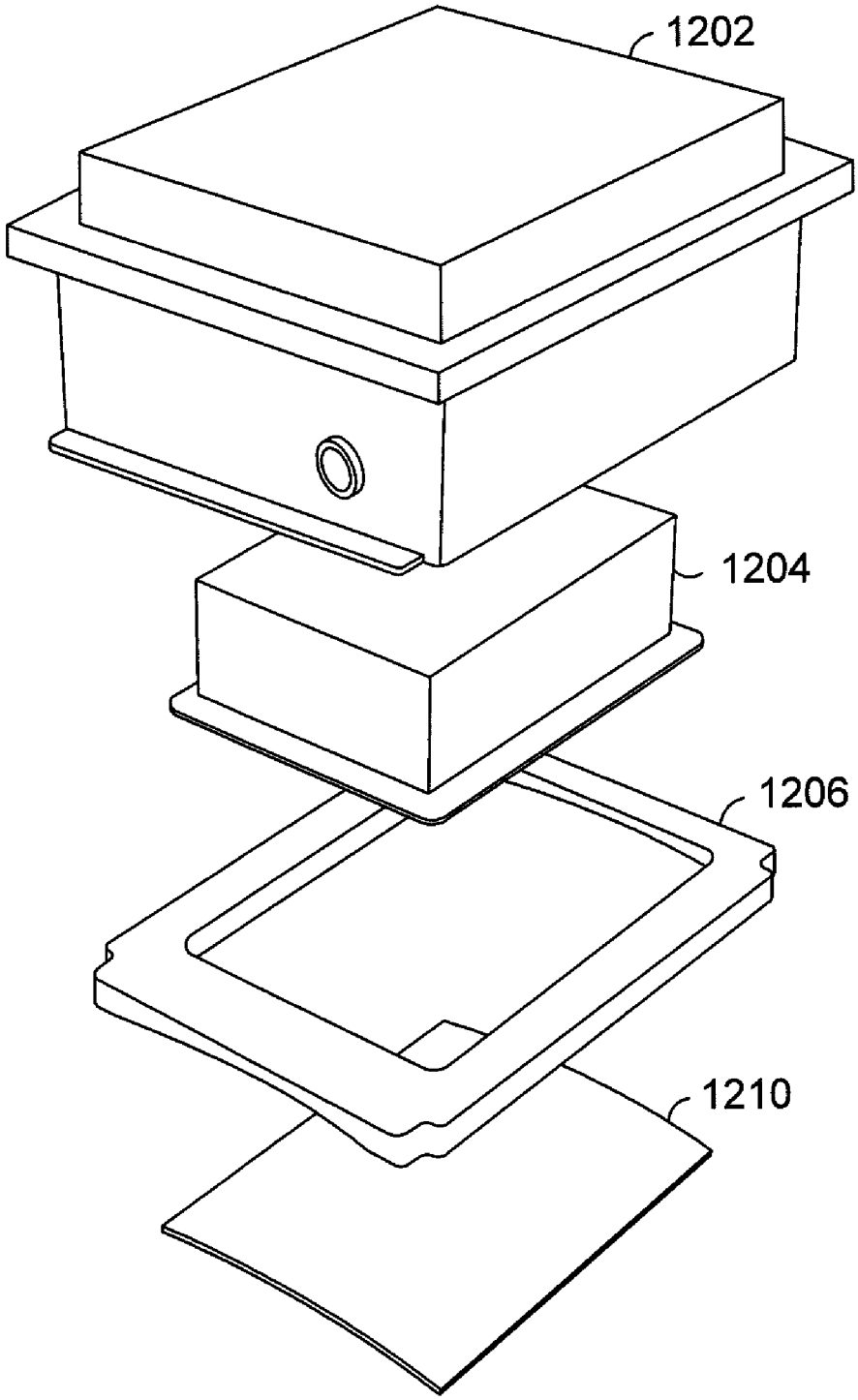

Referring now to FIGS. 12A and B, a housing embodiment can be seen. This embodiment relates to a method of mounting a skylight, baseplate, or some sort of electrical or mechanical device to a wall, e.g., a cylindrical wall of a water slide of various diameters and radiuses or some other walled structure.

As can be seen in the figures, an adapter plate 1206 is mounted on the outer surface of wall 1208. In this embodiment, wall 1208 is a tubular waterslide. The fasteners 1212, e.g., screws, are driven into slide wall 1208. Either before or after the adapter plate 1206 is installed, the wall must be cut into a shape which allows for the passage therethrough of an inner cover 1210. Inner cover 1210 can be a transparent or translucent lens where it is desired to create a skylight effect. In the embodiment shown in FIGS. 12A and B, adapter plate 1206 is installed at a radially upper portion of the slide wall (e.g., at 12 O'clock), and in most instances at the top. But in certain embodiments it will be desirable for it to be offset from the top in some angular relation, e.g., at 10, 11, 1 or 2 O'clock. Additionally, one or more skylights or other devices can be clocked at the same, different, or multiple locations.

Considering the slide wall 1208 has been cut to shape, a light transmitting dome 1204 is secured. The may occur by simply fixing it (using fasteners or an adhesive) to the upper surfaces of the adapter plate 1206. In another embodiment, however, it is pushed up through the hole in the slide (not shown, but would be cut through wall 1208) where a peripheral flange 1216 engages the underside of the adapter plate 1206. Then, an inner cover 1210 is then attached using fasteners 1214. Fasteners 1214 are received into exposed margins (not shown) in the bottom of adapter plate 1206 (which has already been installed). This secures the cover 1210 and dome 1204 in place to create a skylight which can be easily maintained because it is accessible from inside the waterslide.

This can be especially important considering that some slide locations are difficult to access from the outside because the slide is elevated or suspended.

Figure 13A:
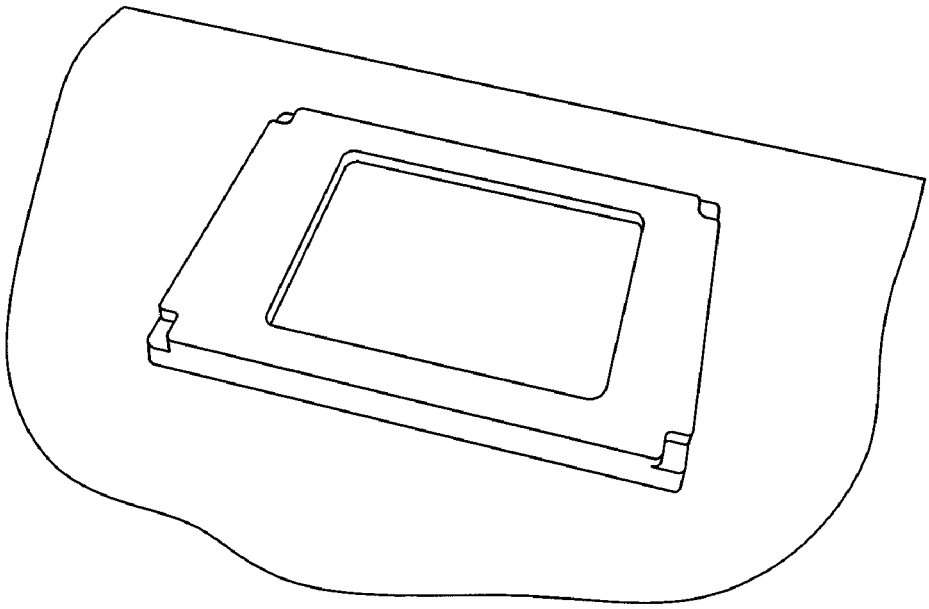
Figure 13B:
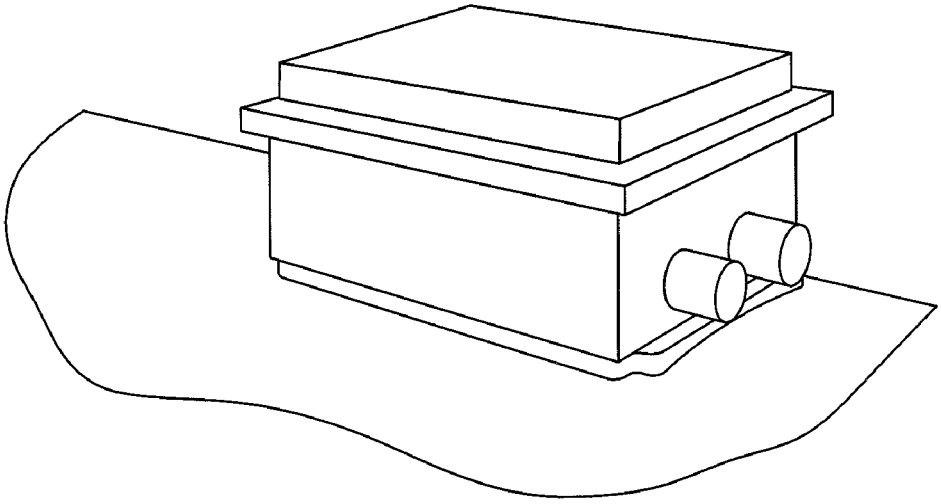
Figure 13C:
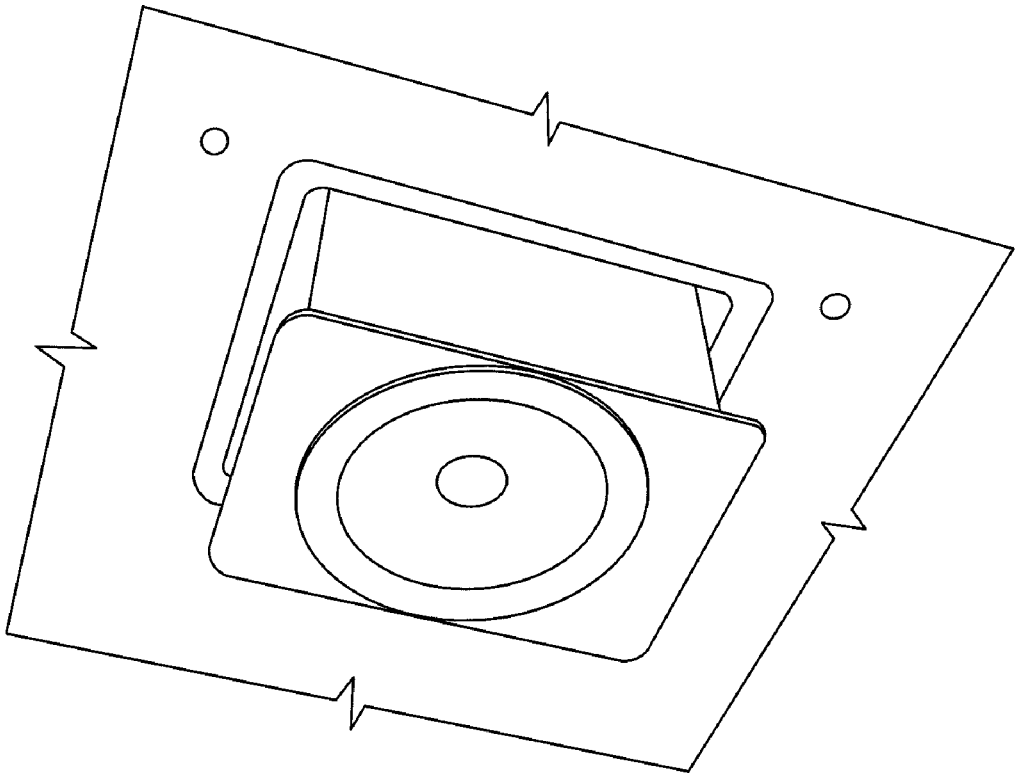
Figure 14A:
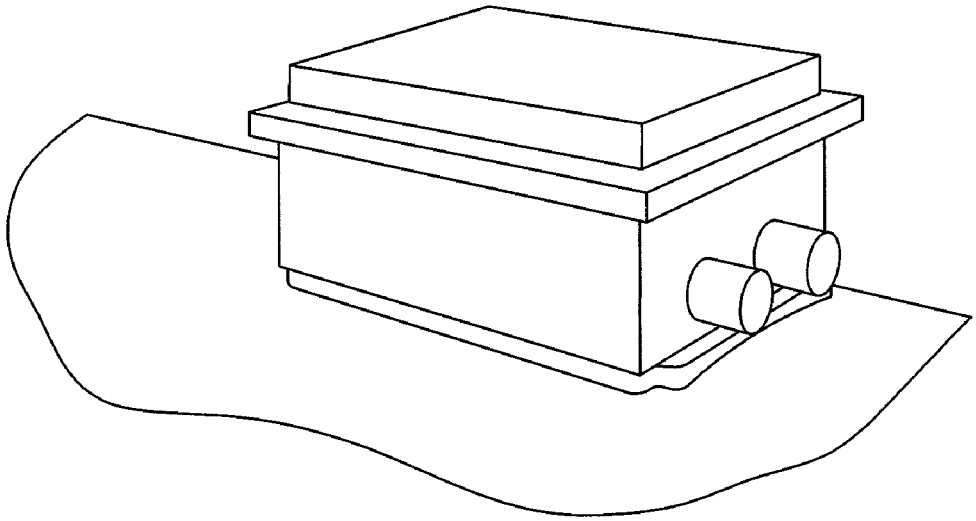
Figure 14B:
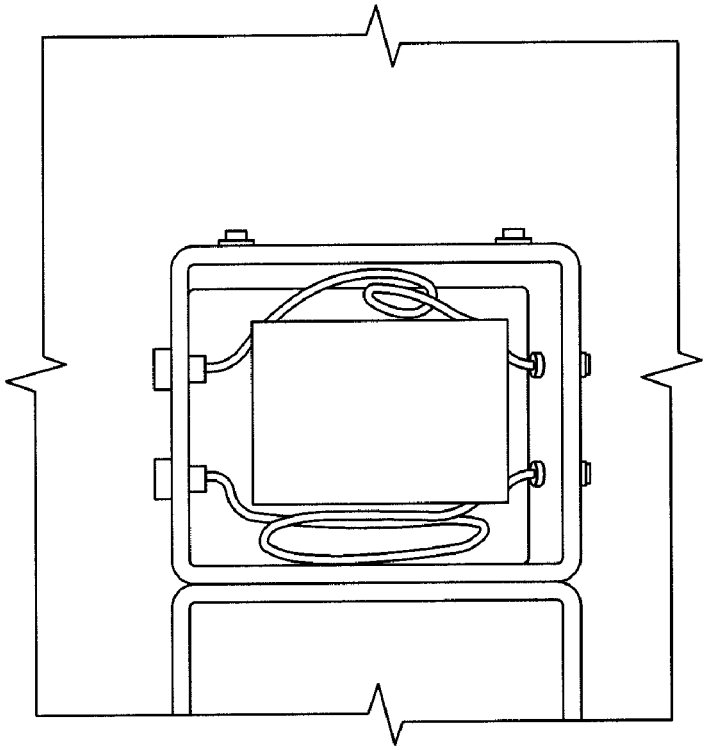
Figure 14C:
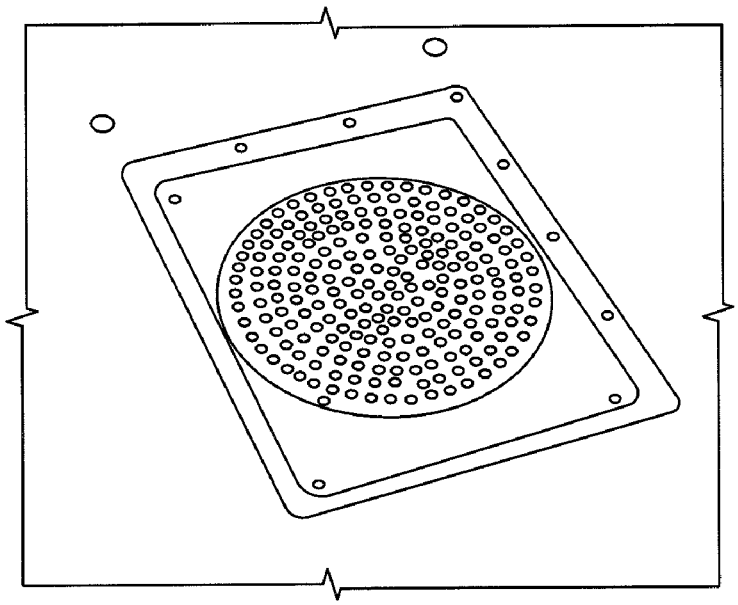

Alternatively, the adapter plate 1206 can be used for allowing for the installation of a light assembly housing, a speaker, or some other kind of electrical equipment. In this sort of assembly, inner cover 1210 may be an optically active or inactive lens for a lighting fixture, a speaker grill for an audio speaker, or some other structure depending on the equipment to be installed. Also in one of these alternative arrangements, dome 1204 will be an electrical enclosure (e.g., like the ones shown in FIGS. 13 and 14). With these arrangements, the equipment including dome 1204 includes an inner enclosure which might have a light or speaker in it. Like was described for the skylight, dome 1204 is then inserted up through the hole cut in the slide wall until peripheral flange 1216 engages, and is followed by the a lens or speaker grill inner cover 1210 which is secured using fasteners 1214. (Even though dome 1204 is shown in the exploded view as being above adapter 1206, it would in this embodiment be installed from below inside the slide).

An outer housing enclosure 1202 is then installed to protect any water sensitive electrical or other equipment in dome 1204. Providing an enclosure such as outer housing 1202 is normally required by code.

Once installed, the assembly is water proof from inside and outside of the slide such that the electronics in the inner enclosure in dome 1204 are adequately protected. Also, the cover 1210 and dome 1214 are easily removable, allowing for service or repairs by removing the outer enclosure 1202 from the outside, or by removing the inner cover 1210 and sliding out the inner enclosure 1204. All this could be accomplished from either in the tube or from outside the tube making providing desirable versatility. Another feature of the outer and inner enclosure design is that it provides, when assembled, two separate areas or raceways to place different voltage wires through. These can be seen in FIG. 14. This is in keeping with national electrical codes that require separation of such different voltages with in the same enclosure.

Another key to this design is that only the adapter plate needs to be shaped differently to accommodate many differently shaped tubes of different diameters and radiuses. An owner can easily exchange inner enclosures between any of the outer enclosures located on any of the possible differently shapes tubes in his possession.

Another advantage is that a buyer can start with a simple skylight on his tube and later add the enclosures without modification to the tube itself. This would save time and labor making it easy to administer upgrades of equipment.

Figure 15:
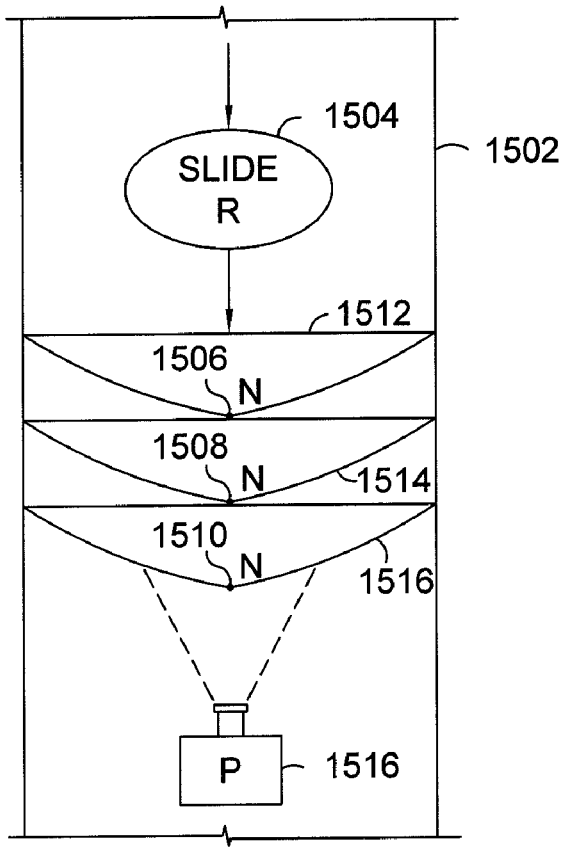
FIG. 15 shows an alternative nozzle-spray arrangement.

An alternative embodiment to the projection arrangement shown in FIG. 8 is disclosed in FIG. 15. This water-screen arrangement produces a contoured shape onto which images can be projected. The nozzles used have a pressurized spray contouring nozzle. This contoured shape produces a three dimensional looking water screen image when it receives the projected image onto the pressurized water flow. Gravity fed flat sheets of water lack contour and appear lifeless. Here, however, the pressurized flow adds the illusion of life to the image.

The view shown in FIG. 15 is like the view of the FIG. 8, except that the spray pattern is different. Shown is a water slide 1502 that is used to entertain a rider 1504. A series of nozzles 1506, 1508, and 1510 (located above like in FIG. 8) create a plurality of spray patterns 1512, 1514, and 1516, respectively, which spray down from above into the slide path as shown. Alternatively, these nozzles could spray out from any number of locations. In looking at the tubular slide in cross section, the nozzles could be located to spray from any clocked locations as is practical. For example, one spray could come out from a side location, another might come out from an opposite side location, or all the nozzles could be at different locations, clocked relative to one another. As can be seen, each of the sheets, in the disclosed embodiment, have contour. Alternatively, the sheets could be flat, however, it has been determined that the contoured nature of the spray patterns enhances the lifelike appearance of the image. Although not shown specifically in the drawing, in some embodiments these spray patterns will be all different, e.g., do not conform to one another such that they have different contours. The non-flatness of these contoured pressurized sprays brings the images projected by projector 1518 to life and makes them more realistically three dimensional. As will be evident from referring back, projector 1518 is also located above in the slide in a housing like that shown in FIG. 8.

Figure 16:
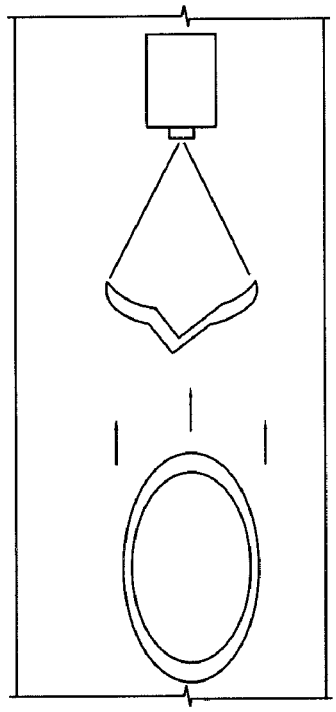
FIG. 16 shows a contoured spray operating in concert with a projected image.

FIG. 16 shows an embodiment where the spray of one nozzle 1602 is configured to generate a spray 1604 which to enable the projection of a three-dimensional face image 1606. From this it can be seen that the pressurized water spray contour can work in concert with projected image 1606 to create a special effect which is viewable by a sliding rider 1608. The spray is made in the shape that is consistent with the image being made by the projector 1610. It should be understood that special contours could also be used with a projection arrangement incorporating a plurality of sprays as disclosed in FIG. 15.

The synchronization of the images produced by the projectors in cooperation with moving the waterscreen contours around is also incorporated into embodiments. For example, moving nozzles could be incorporated to create desirable effects in the embodiments disclosed in FIGS. 1-16 above.

Figure 17:
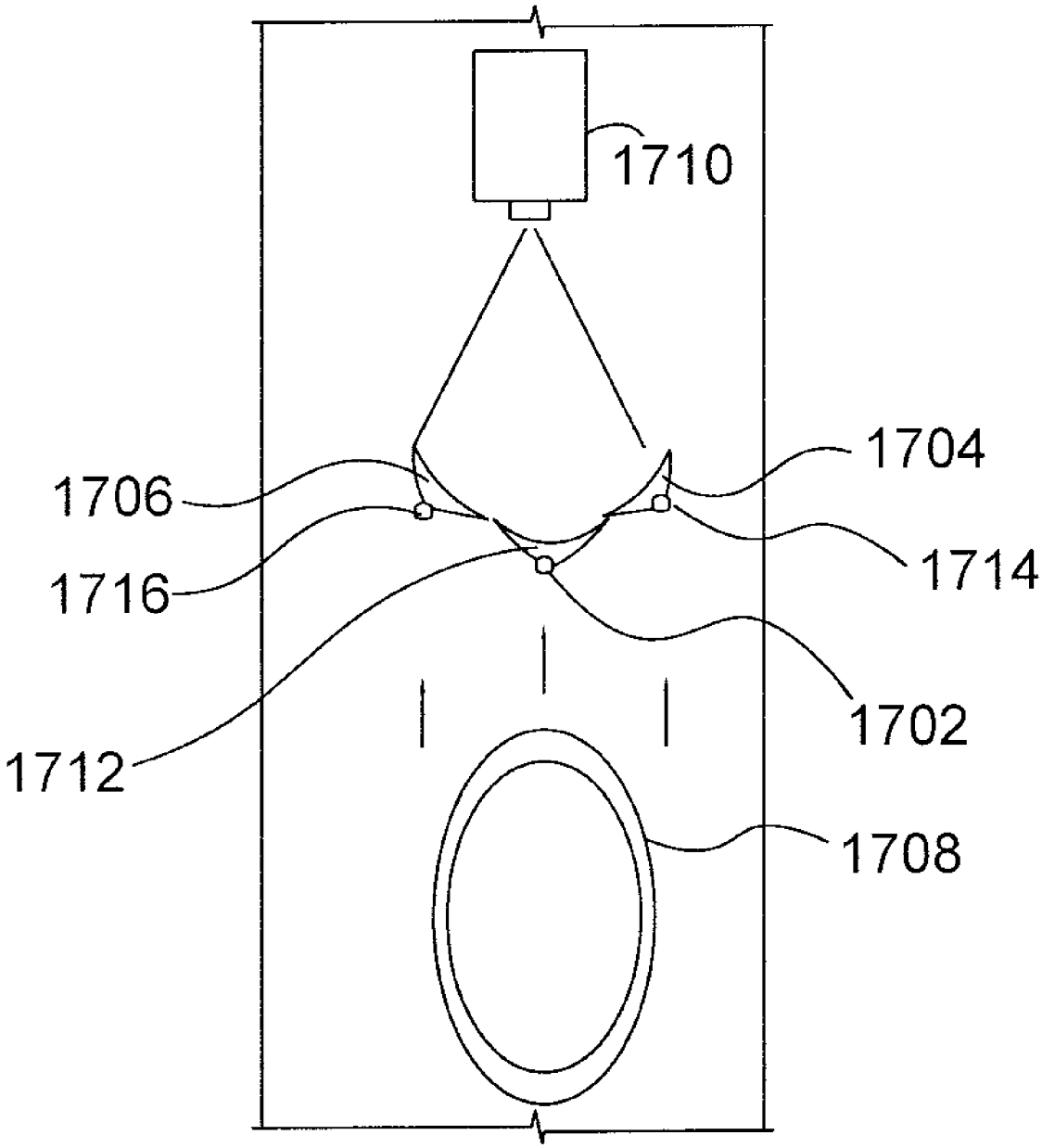
FIG. 17 shows an alternative embodiment showing an optional spray/projection arrangement.

FIG. 17 shows an alternative arrangement including a projector 1710 for presenting an image to a rider 1708. The nozzles here are presented side-by-side and incorporated into an automated moving device to cooperate with the projected image and create life-like animations. Referring to the FIG. 17 embodiment, a plurality of mobile nozzles 1702, 1714, and 1716 are shown. Each of these nozzles 1702, 1714, and 1716 presents a separate spray pattern 1712, 1704, and 1706, respectively, which presents a component of an overall image. Here, a face is formed. The nose, in three dimensions, would appear before the sides of the face. Thus, here, the nose image is presented on spray 1712 eminating from nozzle 1702, which is more forwardly positioned. A second side face portion of the overall image is located on a second spray portion 1706 would be more back and to the left relative to the rider. A third spray image would exist on spray 1704 and would also be back from the nose image, but on the right relative to the rider. The nozzles are movable in at least two and possibly three dimensions, enabling the overall face image to appear to turn, speak, and present numerous other special effects in concert with the images being projected by projector and in syncronization with audio generated from the speakers. The visuals created enable the presentation of depth and motion using the sprays.

It should be noted that the above embodiments would be useful in numerous other environments. For example, the inside-the-tubular-slide accessible housing structures for the lighting, projection, audio, skylights, and other structures disclosed would also be useful for providing access in dark enclosed areas of roller coasters. Roller coaster arrangements might also use the projection/water spray/water mist/water vapor arrangements or the computer-aided touchscreen arrangements. Thus, the disclosed invention would not be limited to use in the environments disclosed unless otherwise specified.

As can be seen, the present invention and its equivalents are well-adapted to provide a new and useful waterslide system and method. Many different arrangements of the various components depicted, as well as components not shown, are possible without departing from the spirit and scope of the present invention.

The present invention has been described in relation to particular embodiments, which are intended in all respects to be illustrative rather than restrictive. Alternative embodiments will become apparent to those skilled in the art that do not depart from its scope. Many alternative embodiments exist but are not included because of the nature of this invention. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the order described.

The invention claimed is:

1. A water slide system comprising:

a water slide defining a slide path;

a first water-transmitting device adapted to generate a first nonplanar contoured spray of water into said slide path; and a projection arrangement, said arrangement adapted to project an image into said first nonplanar contoured spray of water for the purpose of creating a special effect which may be seen by said rider before sliding through the image displayed on said first nonplanar contoured spray of water, the first contoured spray of water being positioned at a point of entry for a covered occluded portion of the water slide, said projection arrangement being located inside the covered occluded portion and projecting onto the contoured spray of water from inside the covered occluded portion above and behind the point of entry.

2. The system of claim 1 wherein said slide is enclosed and said projection arrangement comprises:

a projector included in a housing located near an upper portion of said enclosed slide, said housing enabling said projector to be accessed from inside the slide for servicing.

3. The system of claim 1 wherein said water-transmitting device is a nozzle, said nozzle adapted to project said first contoured spray.

4. The system of claim 1 comprising:

a second contoured spray located in spaced relation with respect to said first spray, said image being also directed into said second contoured spray for the purpose of contributing to said special effect which may be seen by said rider before sliding through said first and second contoured sprays of water.

5. The system of claim 4 comprising:

a third contoured spray located in spaced relation with respect to said second and first sprays, said image being also directed into said third contoured spray for the purpose of contributing to said special effect which may be seen by said rider before sliding through said first, second, and third contoured sprays of water.

6. The system of claim 5 wherein said first, second, and third sprays all have different contours.

7. The system of claim 4 wherein said first contoured spray has a configuration which does not correspond to said first spray.

8. A water slide system comprising:

a water slide defining a slide path;

a computer-generated user interface presenting a menu to a rider, said menu including a first ride theme option and a second ride theme option, said interface further adapted to enable said rider to make a selection of one of said first and second ride theme options; and a computing arrangement adapted to receive said selection and then cause a three-dimensional visual effect to be created in said waterslide, said effect being consistent with said selection of said first and second ride theme options;

said three-dimensional visual effect being positioned in front of a point of entry into a covered portion of the slide and being projected from a concealed housing above the covered portion of the slide.

9. The system of claim 8 wherein said covered portion comprises:

a water nozzle at the point of entry of the covered portion, said nozzle adapted to generate a contoured spray of water into said slide path; and a projection device adapted to project an image into said contoured spray of water for the purpose of creating said three-dimensional visual effect which is related to said selection of one of said first and second ride theme options.

10. The system of claim 9 wherein said nozzle is adapted to project a pressurized substantially flat spray screen.

11. The system of claim 9 wherein said nozzle is adapted to project a non-planar contoured spray screen.

12. The system of claim 8 comprising:

a sensor for sensing the presence of a rider at a particular location on said slide, transmitting a signal; and a process on said computing arrangement for receiving said signal and then creating said three-dimensional visual effect at a time and location at which said three-dimensional visual effect can be experienced by said rider at such a time the rider approaches the point of entry.

13. The system of claim 12 wherein said three-dimensional visual effect is created using a plurality of water spray screens and a projector.

14. The system of claim 13 comprising at least one sound generating device creating an audio effect complementing said three-dimensional video effect.

15. The system of claim 13 wherein said three-dimensional visual effect is created using a plurality of water spray screens and a projector and said projector is adapted to project an image into said spray screens of water such that said three-dimensional visual effect may be seen by a water-sliding user traveling in a slide path on a cushioning device, said three-dimensional visual effect including an image, said image being positioned for display such that said water-sliding user slides through said water screen where said image is created.

16. The system of claim 13 wherein said slide is enclosed and said projector is included in a water-shielded housing above a slide path and said projector is oriented such that it projects through a transparent sheild, and said projector is accessible for maintainence from inside said waterslide.

17. The system of claim 8 wherein said computer-generated user interface is presented using a touchscreen at a location near a beginning point of said slide, and said creating an effect on or about said waterslide, and said system is adapted such that said three-dimensional visual effect is made to be thematically consistent with which of said first and second ride theme options is selected using said touch screen.

18. The system of claim 17 comprising:

a database adapted to save information related to said selection made by said rider so that it may be retrieved at a later time.

19. The method of claim 17 comprising:

a remote interface arrangement which enables a technician to remotely monitor said computing arrangement.

20. The method of claim 17 comprising:

said computing arrangment adapted to receive information from a removable computer media for the purpose of allowing theme changes to a location without having technical personnel present.

21. A system for use with a waterslide, the waterslide providing a cascading stream of water in a slidepath in which a user slides on a cushioning device for entertainment, said system comprising:

a hood portion installed above a slide path in a covered portion in the waterslide;

a projector installed in said hood, said projector being oriented such that it projects onto a water screen which is produced by a nozzle in a first contoured spray pattern and positioned in a slide path of said waterslide such that a rider will slide through said screen;

a water-protected housing for the projector in the hood, the housing allowing access to by a person reaching up from inside the covered portion of to slide into the hood for servicing the projector while the person is supported by the slide.

22. The system of claim 21 wherein said spray pattern is a part of a plurality of spray patterns, said plurality all used to receive portions of said image.

23. The system of claim 22 wherein said system also includes a waterproof housing for one of a lamp and a speaker that enables maintainence from inside the slide.

* * * * *